United States Patent [19]

Kamody

[11] 4,322,221

[45] Mar. 30, 1982

[54] PROCESS FOR THE SUPERATMOSPHERIC GASIFICATION OF SOLID CARBONACEOUS MATERIALS

[75] Inventor: John F. Kamody, Irwin, Pa.

[73] Assignee: Koppers Company, Inc., Pittsburgh, Pa.

[21] Appl. No.: 180,124

[22] Filed: Aug. 21, 1980

Related U.S. Application Data

[63] Continuation of Ser. No. 64,762, Aug. 8, 1979, abandoned.

[51] Int. Cl.[3] ..... C10J 3/00

[52] U.S. Cl. ..... 48/197 R; 44/51; 48/DIG. 2; 55/68; 55/73; 252/309; 406/197; 423/416

[58] Field of Search ..... 44/51; 260/544 R; 570/262, 263; 423/416, 542; 252/373, 309; 203/81, DIG. 4; 55/73, 68; 48/197 R, 202, 210, DIG. 7; 406/197, 47

[56] References Cited

U.S. PATENT DOCUMENTS

| | | | |
|---|---|---|---|
| 2,016,804 | 10/1935 | Nichols | 260/652 |
| 2,560,478 | 7/1951 | Roetheli | 48/210 |
| 2,735,787 | 2/1956 | Eastman et al. | 48/DIG. 7 |
| 3,140,123 | 7/1964 | Bowen | 406/109 |
| 3,762,133 | 10/1973 | Merriman et al. | 55/73 |
| 3,929,429 | 12/1975 | Crouch | 48/197 R |
| 4,020,144 | 4/1977 | Bosniack | 55/73 |
| 4,060,397 | 11/1977 | Buiter et al. | 48/210 |
| 4,115,081 | 8/1978 | Ohno et al. | 55/73 |
| 4,153,427 | 5/1979 | Bissett et al. | 48/DIG. 7 |
| 4,156,594 | 5/1979 | Tarpley, Jr. | 44/51 |

FOREIGN PATENT DOCUMENTS

| | | | |
|---|---|---|---|
| 152285 | 7/1953 | Australia | 48/DIG. 7 |
| 165423 | 6/1921 | United Kingdom | 44/51 |

OTHER PUBLICATIONS

G. G. Hawley, "The Condensed Chemical Dictionary" 8th Edition, 1974 pp. 169–170.

*Primary Examiner*—S. Leon Bashore
*Assistant Examiner*—Michael Goldman
*Attorney, Agent, or Firm*—Donald M. MacKay; Herbert J. Zeh, Jr.; Oscar B. Brumback

[57] ABSTRACT

A process is disclosed for gasifying solid carbonaceous material at elevated temperature and pressure to produce a gas consisting of carbon monoxide and hydrogen, which comprises forming a slurry at atmospheric pressure of the carbonaceous material with a liquid having a specific gravity of from 1.1 to 1.9, a boiling temperature of at least 70° F., a latent heat of vaporization less than about 200 BTU per pound, a critical temperature which is less than the incipient coking temperature of the carbonaceous material, a stability at temperatures up to 600° F., an essentially inert chemical reaction with the carbonaceous material at temperatures less than about 600° F., an immiscibility with water or solubility in water at no more than 5%, and a dissolving ability for hydrogen sulfide at temperatures of from −40 to 250° F., and raising the formed slurry to a pressure of at least the gasification pressure and vaporizing said liquid and gasifying said carbonaceous material, either in the same or in separate steps. Examples of suitable slurrying liquids are: carbon tetrachloride, carbon disulfide, trichloroethylene, bromoethane, chlorobenzene, methane dichloride, chloroform, or mixtures thereof.

12 Claims, 3 Drawing Figures

PROCESS FOR THE SUPERATMOSPHERIC GASIFICATION OF SOLID CARBONACEOUS MATERIALS

This is a continuation, of application Ser. No. 064,762, filed Aug. 8, 1979 now abandoned.

BACKGROUND OF THE DISCLOSURE

There are many known advantages to the gasification of solid carbonaceous materials at superatmospheric gasification pressures. However, a major limitation in the operation of a pressurized gasifier has been the problem of feeding the solid carbonaceous material to the gasifier in a reliable, inexpensive, and efficient manner. Heretofore, feeding systems for the carbonaceous materials to the gasifier have generally involved the use of lock hoppers or sophisticated and complex mechanical feeding devices.

Lock hoppers involve the use of a compressible gas, such as nitrogen, to alternatively pressurize and depressurize a plurality of vessels to that the coal is introduced to the system effectively at atmospheric pressure. However, lock hoppers suffer major disadvantages which include high energy for compression of the gas, large volumes for the lock hopper vessels, control problems, and erosion of valves due to dust which interferes with the valve sealing surfaces.

Mechanical coal feeders, such as piston feeders, extruders, and centrifugal coal pumps, demand very close tolerances inasmuch as these feeders must actually pump the solid carbonaceous materials across a high pressure differential. As a result, mechanical feeders are often characterized by high expense, poor reliability, and a very high inefficiency due to friction. In addition, since the solid carbonaceous materials are abrasive, mechanical feeders display a great deal of wear and demand frequent overhauls.

A development which has improved the problems associated with obtaining the close tolerances in a mechanical coal feeder involves slurrying the carbonaceous material (ordinarily coal particles) with water so that this slurry may be pumped by relatively conventional methods. For example, in the well-known Texaco coal gasification process, coal is slurried with water and the slurry is then pumped to a superatmospheric gasifier, such that the water serves the additional purpose of affording an entrainment medium for introducing the coal into the gasifier burners. There are, however, a number of major disadvantages to this method. First of all, there is a big density difference between water (spg. 1) and coal particles (spg. 1.2–1.9). This necessitates maintaining sufficient velocity in the slurry pumping and transport system so that coal does not settle out of suspension. Such velocities can induce a great deal of wear which demands frequent maintenance. Secondly, water has a high latent heat of vaporization, and as copious water is added to the gasifier, much of the coal's energy is wasted in the evaporation of this water. Additionally, as increased water is added to the gasifier a good deal of the coal's energy is consumed in forming hydrogen from water, and in many applications this hydrogen may not be as directly useful as the other products of gasification, such as carbon monoxide. Evaporating the water from the slurry after it is pumped, but before the coal enters the gasifier, is judged not to be practical in view of the high latent heat of vaporization of the water and the high temperatures required to conduct this vaporization at elevated pressures. Recently it has been suggested that methanol could be used alternatively to water for slurrying of the coal. Methanol, however, still has a high latent heat of vaporization, although this latent heat is about half that of water. Moreover, methanol, although producable from the gases made in the gasifier, is a product considered too valuable for addition or recycle to the gasifier.

BRIEF DESCRIPTION OF THE INVENTION

It has now been discovered that the disadvantages of slurries with water or methanol can be obviated by forming a slurry at atmospheric pressure of solid carbonaceous fuel, e.g. coal, with a liquid having a specific gravity of from 1.1 to 1.9, a boiling temperature of at least 70° F., a latent heat of vaporization less than about 200 BTU per pound, a critical temperature which is less than the incipient coking temperature of the carbonaceous material, a stability at temperatures up to 600° F., an essentially inert chemical reaction with the carbonaceous material at temperatures less than about 600° F., an immiscibility with water or solubility in water at no more than 5%, and a dissolving ability for hydrogen sulfide at temperatures of from −40° to 250° F.

Suitable fluids meeting the above qualifications are carbon disulfide and halogenated hydrocarbons to include: trichlorethylene, bromoethane, chlorobenzene, and chloromethanes to include carbon dichloride, carbon trichloride, and carbon tetrachloride. Mixtures can also be employed of the above or other fluids such as carbon monochloride providing that the mixture possesses the requisite properties. A preferred mixture is of $CS_2$ and $CCl_4$ in a ratio to approximate the density of the coal particles. The advantage of employing a liquid of the invention can be illustrated with carbon tetrachloride and carbon disulfide. First, the density of $CCl_4$ (1.6) and $CS_2$ (1.2) more closely approximate the typical density of coal particles (1.2–1.9). A miscible mixture of $CS_2$ and $CCl_4$ is good because a mixture can be formulated to closely approximate the density of the particular coal. Although coal particle densities vary between 1.2–1.9, most coals being considered for gasification in the United States range in density from 1.2–1.5. Consequently, less agitation and lower velocities are needed to maintain a slurry and to pump it. In addition, the surface tension of $CCl_4$ and $CS_2$ is low. Thus, very stable coal slurries can be made from $CCl_4$ and $CS_2$. Secondly, the latent heat of vaporization of $CCl_4$ is only about 85 BTU/lb., and that of $CS_2$ is about 158 BTU/lb. at 25° C., in contrast to 1049 BTU/lb. for water at 25° C. Thus, significantly less energy is required to evaporate the liquid. In addition, both compounds are reasonably volatile and the temperatures required for vaporizing these compounds are easily attained.

Three embodiments exist for practice of the invention, depending on the intended application for the gasification process. In the first embodiment, coal is slurried at atmospheric pressure with $CCl_4$, $CS_2$, or with a mixture of $CCl_4$ and $CS_2$, and the slurry is then transferred at a pressure of at least the gasification pressure directly into the gasifier. Normally in this embodiment, $CCl_4$ would be included in the slurry only if it is desired to employ the product gas from the gasifier for the synthesis of various chemicals which employ chlorine or chlorine compounds directly or as precursors for example: the production of phosgene gas from carbon monoxide with the phosgene gas then used, for example, to produce toluene diisocyanate. The slurry fed to the gasifier would typically contain 50–70% by weight liquid, and due to the high molecular weights of $CCl_4$ and $CS_2$ (154 and 76, respectively), there is little influence of these two compounds on the volume of gas produced in the gasifier, nor is there any significant interference by these two compounds on the basic known gasification reactions, such as the reaction of carbon with oxygen. Although $CCl_4$ and $CS_2$ display similar physical properties, they display different chemical properties, although each is relatively stable. The $CCl_4$ has historically been principally used in the past as a fire extinguishing agent. Thus the $CCl_4$ is, for the most part, merely evaporated into the raw gas produced in the gasifier. Some $CCl_4$ decomposition or additional reactions however are possible, for example: some $CCl_4$ may be converted to phosgene, or hydrogenated to other chloromethane compounds, or else reacted or decomposed to form $Cl_2$ or HCl. These side products may not interfere with the intended application of the gasification process, or else they can be recovered from the gas by known methods and then reprocessed to chlorine gas, which in turn can be reconverted to $CCl_4$ by known methods. The $CS_2$, like $CCl_4$, can also be merely evaporated into the gas, especially if the gasification process selected for practice of the invention is a two-stage gasifier. Additionally with a two-stage gasifier it would be possible to form some methane from the $CS_2$ by its reaction with $H_2S$ or with $H_2$. If the $CS_2$ is contacted with free oxygen, as in a single-stage gasification process, the $CS_2$ would be readily burned to $SO_2$ or COS, but the $SO_2$ would then be reduced by hydrogen in the gasifier to $H_2S$. This $H_2S$ and COS are easily recovered from the gas, as would be the $H_2S$ and COS generated from the sulfur ordinarily present in the carbonaceous fuel.

In the first embodiment of the invention, the raw gas leaving the gasifier is passed through a waste heat boiler and then through cyclone separators for removal of most of the entrained particulates. Residual particulates are removed from the gas by then scrubbing the gas with a chilled stream of $CCl_4$, $CS_2$, or a mixture thereof. Both $CCl_4$ and $CS_2$ display low surface tensions which is advantageous for scrubbing purposes. Simultaneously with scrubbing of particulates the $CCl_4$ and $CS_2$ initially contained in the raw gas may be condensed, and such condensed $CCl_4$ and $CS_2$, along with any suspended particulates, may be recycled to the slurry preparation step of the invention. Any water condensed may be removed from the scrubbing solution by decantation, in that both $CCl_4$ and $CS_2$ are immiscible in water. Additionally, both $CCl_4$ and $CS_2$ will absorb $H_2S$ and other sulfur compounds from the raw gas, and such $H_2S$ may be regenerated from the scrubbing solution by application of heat and/or reduction in pressure.

In a second embodiment of the invention, the slurry is initially formed at atmospheric pressure and the $CCl_4$ and $CS_2$ may be evaporated later at elevated pressure from the slurry before coal is introduced to the gasifier, with the recovered $CCl_4$ and $CS_2$ then recycled to the slurry preparation step. Coal fed to the gasifier then contains only traces of $CCl_4$ and $CS_2$.

In a third embodiment of the invention, the $CCl_4$ and $CS_2$ are evaporated from the solution before the coal is added to the gasifier as in the manner of the second embodiment, however, extraction and distillation steps are employed to ensure that the coal fed to the gasifier contains traces of $CS_2$, but no traces of $CCl_4$.

Make-up $CS_2$ and $CCl_4$ required for the process of the invention can be made in a known conventional manner, employing raw materials which are compatible with the products of any coal gasification process. Make-up carbon disulfide can be made by the old process of reacting carbon with sulfur in an electric furnace. Alternatively, carbon disulfide can be made by known methods from sulfur and methane or other hydrocarbons. Carbon tetrachloride, or other chloromethane compounds, can be made by known methods involving the reaction of methane with chlorine. Alternatively, carbon tetrachloride can also be produced by known methods which are based on the reaction of carbon disulfide with chlorine.

DETAILED DESCRIPTION OF THE INVENTION

Disclosed is a process for producing a synthesis gas containing CO and $H_2$ which comprises mixing a liquid of a chloromethane (preferably $CCl_4$), carbon disulfide, or mixture thereof and solid particles of carbonaceous fuel together in a mixing zone to produce a substantially water-free pumpable and stable slurry; introducing said slurry at a temperature and pressure in the range of between about 32 and about 85° F., and between about 3 and about 170 atmospheres into a gasifier or else passing the slurry into a vaporizer for removal of the liquid, with the liquid-free carbonaceous material then passed into a gasifier.

The ratio of liquid to carbonaceous material will depend upon the materials but generally from between about 50% to about 70% by weight liquid will be employed. Ordinarily the ratio of $CCl_4$ to $CS_2$ will be such as to give an average density for the liquid which closely approximates the density of the carbonaceous material.

The term carbonaceous material as used herein includes solid carbonaceous and hydrocarbonaceous feedstock to include coal, coke from coal, char from coal, petroleum coke, particulate carbon, oil shale, tar sands, and pitch.

Figure 1:
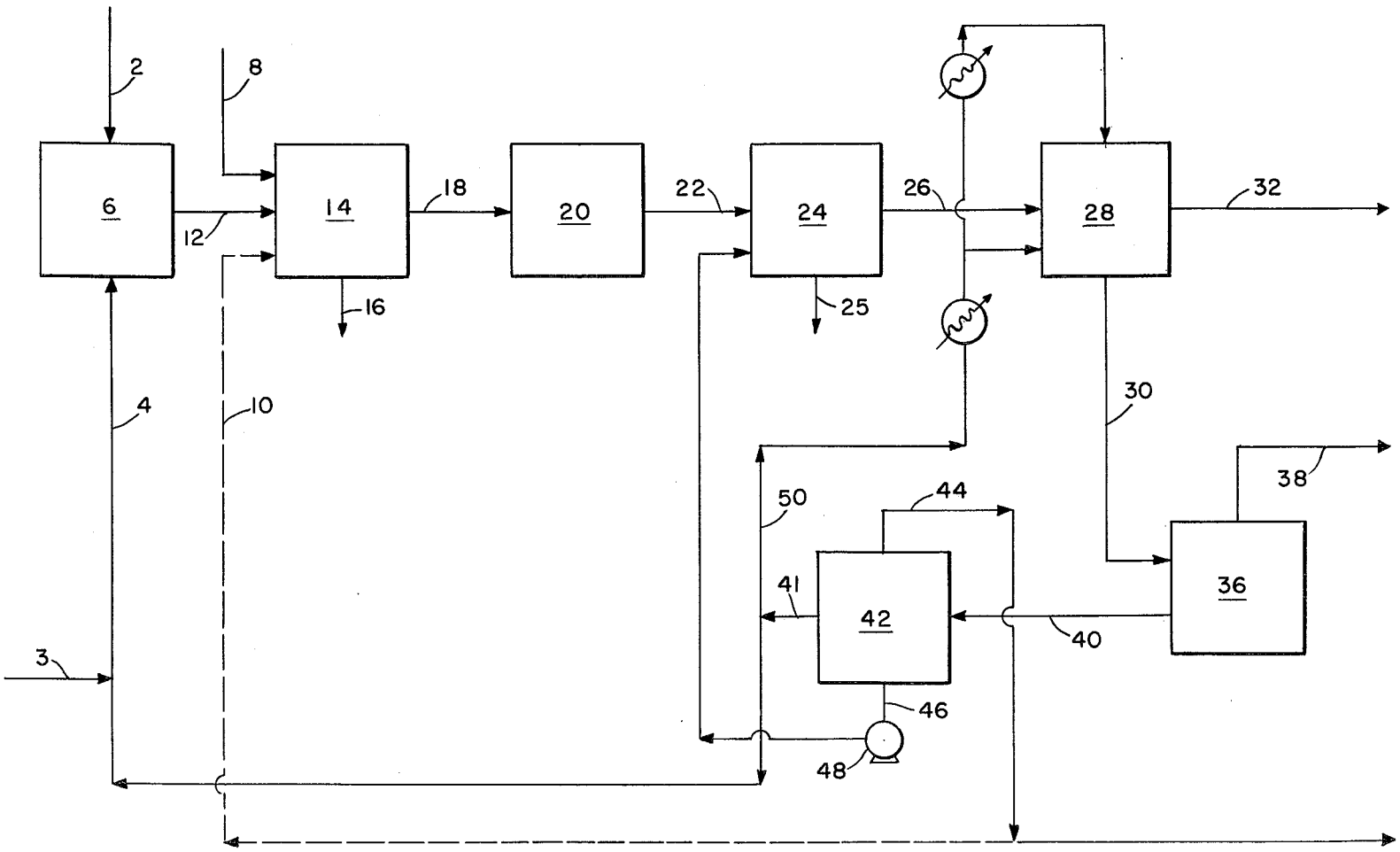
FIG. 1 is a flow diagram of the invention process.

Referring now to FIG. 1, carbon tetrachloride or carbon disulfide, or a mixture thereof, from conduit 4 is used to slurry (at atmospheric pressure) pulverized coal (preferably dry) from conduit 2 at tank 6. A water layer is maintained on the top of the contents of tank 6 as a means of reducing fuming of the liquids. Any surplus water present in the coal is removed by decanting this water from the tank. The relatively stable slurry is then pumped via conduit 12 into a superatmospheric gasifier 14 maintained typically at a temperature of at least 1700° F. and a pressure of up to 270 atmospheres. To the gasifier is also added oxygen, via conduit 8. Steam or carbon dioxide (not shown) may also be added to the gasifier for purposes of supplying additional reactants or for moderating gasifier temperature. Additionally, water recovered later in the process of the invention may be atomized into the gasifier via conduit 10. The gasifier may be of single-stage or multi-stage design. The carbon tetrachloride is vaporized within the gasifier. A small amount of the $CCl_4$ may additionally be converted to chloromethane compounds, phosgene, HCl, or chlorine gas. Likewise, much of the $CS_2$ is vaporized, but additionally some of the $CS_2$ can be reacted directly or indirectly to form $H_2S$ or COS, and additionally some of the $CS_2$ may react with $H_2$ or $H_2S$ to form methane. The gases are then passed through conduit 18 to steam generator 20 wherein the gases are cooled down to about 350° F. The gases are then passed through conduit 22 to cyclones 24 wherein about 90% of the entrained particulates are removed as dry fly dust via conduit 25. The gases are conveyed via conduit 26 to scrubber 28 which is preferably a venturi type scrubber which is indirectly cooled by cold water and a refrigerant, if required. Product gas containing carbon monoxide and hydrogen is removed through conduit 32 for further processing. Because the temperature of the gas which leaves via conduit 32 is preferably about −20° F. or lower, the gas contains very little carbon tetrachloride or carbon disulfide. The condensed carbon tetrachloride, carbon disulfide, and water are removed via conduit 30 and passed to acid gas regenerator 36, wherein any dissolved $H_2S$ and COS may be regenerated by the application of heat and/or the reduction in pressure. The mixture is removed via conduit 40 and cooled if necessary and passed to decanter or clarifier 42. The water is separated by gravity and passed via conduit 44 for disposal or through conduit 10 for addition to the gasifier. Dense particulates (ordinarily high in ash content) which settle in the decanter may be pumped in a slurry form to the cyclones via conduit 46 by means of pump 48. There the carbon tetrachloride and carbon disulfide present in the slurry is re-evaporated into the gas leaving the cyclones. Carbon tetrachloride and carbon disulfide recovered from the decanter 42 are also passed, via conduits 41 and 50 to scrubber 28 after cooling with water and with a refrigerant, if necessary, where they absorb all or a portion of the $H_2S$ and other non-polar gases such as carbon dioxide. Finally, the balance of the carbon tetrachloride and carbon disulfide are passed via conduit 4 to prepare the coal slurry. Make-up carbon tetrachloride and carbon disulfide which may be required are added via conduit 3. In the usual application for the embodiment of the invention, depicted by FIG. 1, any residual chlorine containing compounds in the product gas removed by conduit 32 are expected to present no problems. However, if these chlorine containing compounds are undesirable, they may be removed by known methods and reprocessed to form make-up carbon tetrachloride.

Figure 2:
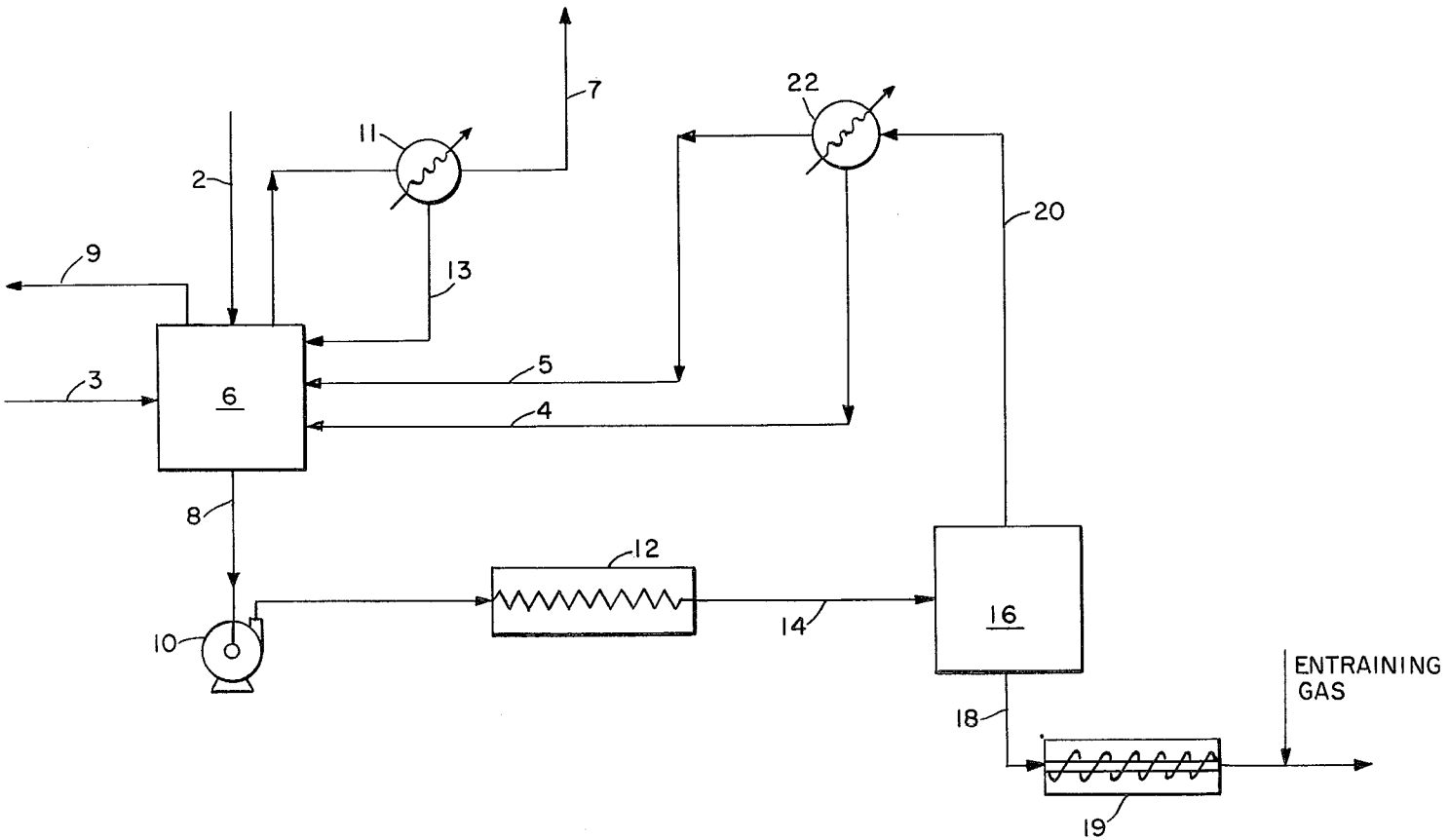
FIG. 2 is a flow diagram of an alternative embodiment.

In FIG. 2, a slurry is prepared at station 6 from coal passed via conduit 2, a small amount of make-up carbon tetrachloride and carbon disulfide via conduit 3 and carbon tetrachloride and carbon disulfide condensate and vapors from conduits 4 and 5. As in the case of the embodiment depicted by FIG. 1, a water layer is maintained on top of the contents of tank 6 to supress any fuming. Residual volatiles of $CCl_4$ and $CS_2$ however are minimized in their release to the atmosphere by means of a refrigerated vent gas condenser 11. A small amount of water which forms from any water present in the coal is removed via conduit 9 and treated for any desired disposition. The slurry which is at a temperature of from 32°–85° F. and at one atmosphere of pressure is passed via conduits 8 to pump 10 whereupon it then enters preheater 12, at a pressure ranging from 3–170 atmospheres. The slurry is to contain as little $CCl_4$ and $CS_2$ as possible, and typically will contain 30–50 wt. % solids. The preheater normally operating with 900–1000 psig saturated steam raises the temperature of the slurry to above the critical temperatures of $CCl_4$ and $CS_2$, which are 523° F. and 541° F., respectively. The slurry is vaporized and passed via conduit 14 to flash tank 16 which is operated at a temperature of up to 550° F. at 3–170 atmospheres of pressure. Alternatively to the use of the preheater 12, heat may be indirectly added to the flash tank 16 for purposes of evaporating $CCl_4$ and $CS_2$. The flash tank is fitted with a micrometallic filter with automatic gaseous blowback (details not shown). Alternatively, cyclone separators may be used instead of the micrometallic filter. Carbon tetrachloride and carbon disulfide vapor are removed via conduit 20 and passed to condenser 22. The dry coal solids are removed via conduit 20 and passed via screw feeder 19 to a coal gasifier maintained at 3–170 atmospheres of pressure. A suitable entraining fluid such as gaseous $CO_2$, or steam may be used for conveying the dry coal into the gasifier.

With the embodiment of the invention depicted by FIG. 2, the dry coal fed to the gasifier contains only traces of $CCl_4$ and $CS_2$ within the void volume of the coal. In certain applications it may be desired that no trace of $CCl_4$ be present in the void volume of the coal, whereas any trace of $CS_2$ would present no objection. If such is the case, the embodiment of the invention depicted by FIG. 3 may be employed.

Figure 3:
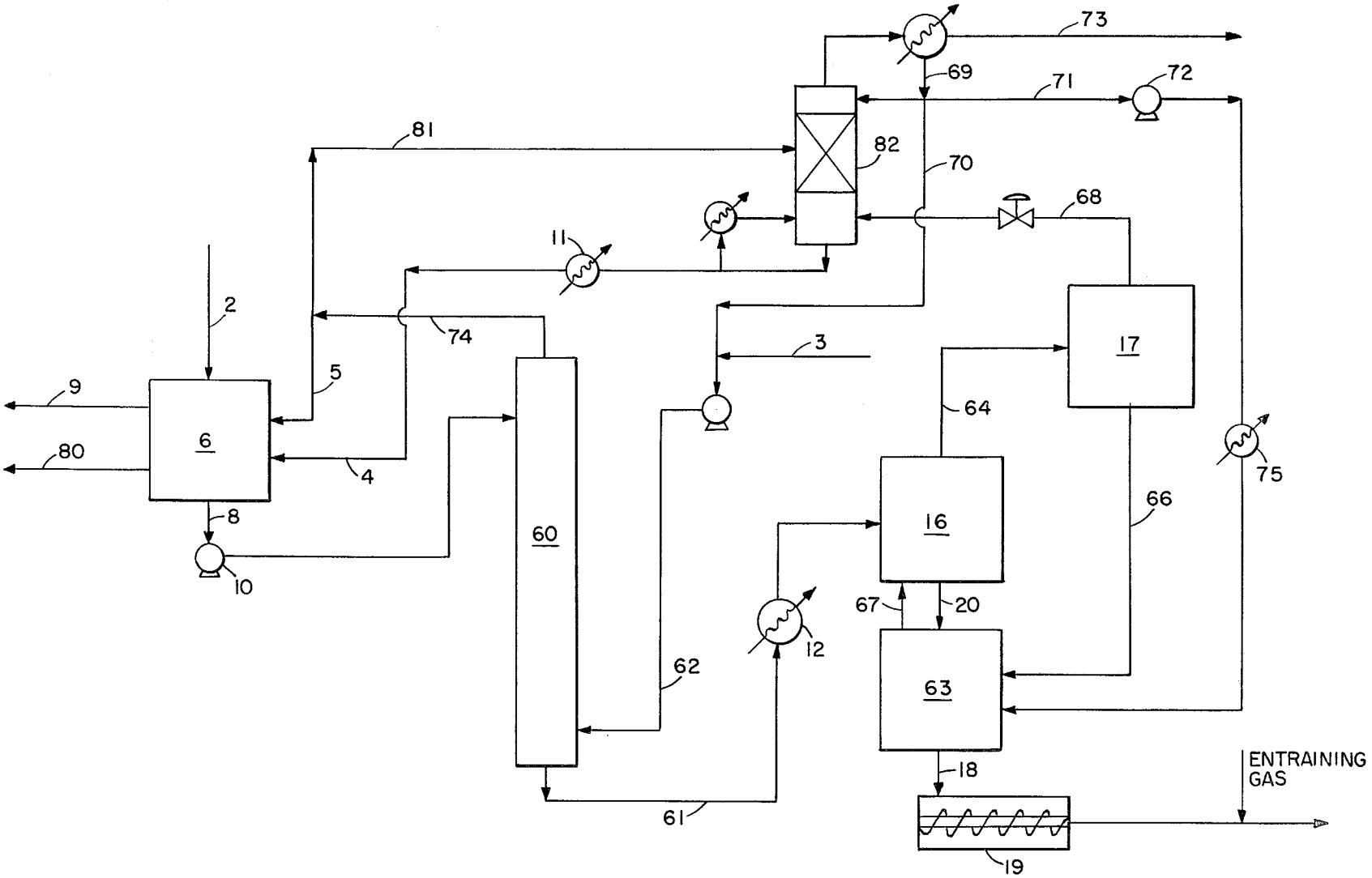
FIG. 3 is a flow diagram of another alternate embodiment.

Referring to FIG. 3, pulverized coal is first slurried at atmospheric pressure in tank 6 with a mixture of $CS_2$ and $CCl_4$, brought into the tank via conduits 4 and 5, the proportions of which are such as to match as closely as possible the density of the coal particles, to thereby give a very stable suspension. A water layer would be maintained on top of the tank to reduce escaping fumes of $CCl_4$ and $CS_2$. Very dense particles (ordinarily of high ash content and not well suited for gasification) may be recovered by gravity settling via conduit 80, if so desired. These recovered dense particles would then be washed with water so that the dense particles may be disposed if desired. Washings from this operation would be sent to a decanter (not shown), so that $CCl_4$ and $CS_2$ may be recycled to the slurry preparation tank. Any surplus water which appears in the system as a result of its presence in the coal feed may be removed from the slurry tank via conduit 9 by decantation and then treated if necessary. The slurry preparation tank 6 may be agitated, if desired, and the temperature should be kept as reasonably low as possible by use of indirect cooling (not shown). Refrigeration if necessary may be employed on any vent lines for the tank to thereby minimize $CS_2$ and $CCl_4$ loss to the atmosphere.

The pressurized slurry is then passed by means of pump 10 and conduit 8 to a continuous counter-current or cross-current extraction process 60, where pure $CS_2$ from later in the process is used to extract $CCl_4$ from the slurry. The extract, containing most of the $CCl_4$ used in the process is removed from the extraction process via conduit 74. A portion of this extract is recycled by conduit 5 to the slurry preparation tank, and the remaining amount is conveyed by conduit 81 to a distillation column 82. The extract may be filtered before recycling to the slurry tank, but such filtration is not essential to the process. The extraction operation is conventional and may employ any of the well known extraction methods which are commonly practiced.

The slurry leaves the extraction unit via conduit 61 and consists primarily of coal and $CS_2$. The $CS_2$, along with residual $CCl_4$, is then evaporated from the slurry. Ordinarily the evaporation step involves heating of the slurry above the critical temperature of both $CS_2$ and $CCl_4$. Critical temperatures for $CS_2$ and $CCl_4$ are 523° F. and 541° F., respectively. Use of 1000 psig saturated steam is quite adequate for supplying such temperatures. The evaporation may be conducted by preheating the slurry feed to the evaporator at 12, or by supplying heat indirectly to the evaporator 16. Alternatively, heat may be directly supplied to the evaporator 16 by addition of superheated steam which is subsequently condensed from the evaporated $CS_2$ and $CCl_4$, with the condensate then recovered by decantation (not shown).

Pulverized coal 20 is collected from the vaporator 16 via conduit 20, storage tank 63 and conduit 18 and metered to the burners of the gasifier by means of a screw feeder 19 or a similar device. Since this screw feeder is merely metering the dry coal, and not pumping the coal, there are no unusual problems in operation of the feeder. Metered coal is then entrained into the gasifier by use of any suitable entraining gas, such as steam or carbon dioxide.

Particles entrained with the $CS_2$ and $CCl_4$ evaporated from the coal via conduit 64 are removed by the use of cyclone separators 17, filters, or any other suitable device, with removed particulates then combined via conduit 66 with the coal recovered in the evaporator. Clean vapors from the cyclone separators are then passed by conduit 68 through a control valve which then permits the delivery of the vapors to a distillation column 82 which operates at approximately atmospheric pressure.

The distillation column 82 is operated under reflux so as to obtain an essentially pure $CS_2$ overhead product which is passed via conduits 69 and 70 to be mixed with make-up $CS_2$ from conduit 3 and passed via conduit 62 to extractor 60. Additionally, a small amount of the $CS_2$ is passed back to the column to aid in the distillation, and the non condensibles are removed via conduit 73. A reboiler is normally also provided. Due to the low boiling points of $CS_2$ and $CCl_4$, 15 psig saturated steam is quite adequate for operation of the reboiler. Any $CCl_4$ (along with traces of water vapor) originally present in the feed to the distillation column will be recovered as a bottoms product. In addition any residual particulates will be retained in the bottoms fraction. The bottoms fraction is then indirectly cooled by cooler 11 and returned to the slurry preparation system by conduit 4.

Additionally, some of the $CS_2$ overhead product may be withdrawn by conduit 71 and indirectly superheated by heater 75 so that pure $CS_2$ vapors may be used for purging the void volume of the dry pulverized coal recovered from the evaporator. This ensures that no $CCl_4$ is present in the feed to the gasifier. Purge gas vapor is recycled to the evaporation system by means of conduit 67.

A small amount of some make-up $CS_2$ may be required, depending on how much $CS_2$ is contained in the void fraction of the coal feed sent to the gasifier. This make-up is added by conduit 3 and would be produced externally to the process by one of a number of ways. One well known method (used commercially in the past) involves the reaction of carbon with sulfur in an electric furnace:

$$C+2S=CS_2$$

In the modern commercial method, methane or other hydrocarbons are reacted over clay catalysts to yield $CS_2$ plus $H_2S$:

$$CH_4+2S_2=CS_2+2H_2S$$

The $H_2S$ is then converted to sulfur, as in the well known Claus process.

Both $CS_2$ and $CCl_4$ have been known to partially dissolve some soluble pterographic constituents (vitrain) of coal. According to Lowry in *The Chemistry of Coal Utilization*, the amount of such dissolved material is ordinarily only a few percent of the coal. In the embodiment of the invention depicted by FIG. 1 where coal is introduced to the gasifier as a slurry with $CS_2$ or $CCl_4$, the dissolving of vitrain is of little significance. When the $CS_2$ or $CCl_4$ is evaporated from the coal slurry before introduction to the gasifier, as depicted by FIGS. 2 and 3, there can be a tendency for tarry type materials to collect on the walls of process equipment. This material would be periodically removed by flushing with clean $CS_2$ or $CCl_4$ solvents with the flush liquor then disposed of by a variety of methods, of which one would involve feeding the material to the gasifier. If tarry material accumulates on the dry pulverized coal product this could lead to agglomeration of the coal. This would be off-set, for example, by mechanically agitating the recovered coal particles.

An advantage to the invention is that the $CS_2$ and $CCl_4$ can be evaporated from the slurry at temperatures under 600° F., which is the temperature at which coking of the coal might otherwise present a problem. Some mild devolatilization of the coal may, however, occur to yield some methane and similar low temperature distillation products during the evaporation step of the invention. If such is the case, any non-condensible gases, such as methane, could be recovered from the reflux condenser of the distillation column 82 of FIG. 3. This methane would then preferably be sent by means of conduit 73 shown on FIG. 3 to a Claus process (not shown) which would be used in adjunct with the gasification process.

As an alternative embodiment, the slurry preparation tank may be located at an elevation sufficiently higher than the gasifier to eliminate the need for mechanical pumping. The static head of the slurry permits imparting sufficient motive force for transfer of the slurry to the super atmospheric pressure required. This can be employed whenever the gasifier pressure is relatively low, i.e. within the range of 3–6 atmospheres.

As a further alternative, water, which is immiscible with $CCl_4$ and $CS_2$, may be used for alternatively pressurizing a plurality of slurry preparation tanks in a manner which imitates the operation of well known lock hoppers. This would eliminate any major mechanical items which are exposed to abrasive solids. However, unlike conventional lock hoppers, the energy consumption would be low in view of the fact that water is not compressible. None of the water used would leave the tanks.

As a further embodiment, a plurality of slurry preparation tanks may be employed whenever the carbonaceous material has a wide variation in densities of the individual particles. Within each tank the ratio of $CS_2$ to $CCl_4$ would be different, and would be adjusted such that any carbonaceous material not suspended by one tank would be withdrawn and passed to a second tank where the ratio was such as to suspend it. Slurry from each tank, once brought to the desired pressure such as by pumping, would then be combined and passed to the gasifier or evaporator for processing in accordance with the invention.

Although the invention has been illustrated by the preferred embodiments thereof, it will be apparent to those of ordinary skill in the art that obvious modifications and variations can be made without departing from the true scope of the invention. Accordingly, the invention is to be limited only by the appended claims.

What is claimed:

1. In a process for gasifying solid carbonaceous material at elevated temperature and pressure to produce a gas containing carbon monoxide and hydrogen, the improvement which comprises forming a slurry at atmospheric pressure of the carbonaceous material with carbon disulfide and raising said formed slurry to a pressure of at least the gasification pressure and simultaneously vaporizing the carbon disulfide and gasifying said carbonaceous material.

2. The process of claim 1 wherein the said carbon disulfide is admixed with a second different fluid whose properties have a specific gravity of from 1.1 to 1.9, a boiling temperature of at least 70° F., a latent heat of vaporization less than about 200 btu per pound, a critical temperature which is less than the incipient coking temperature of the carbonaceous material, a stability at temperatures up to 600° F., an essentially inert chemical reaction with the carbonaceous material at temperatures less than about 600° F., an immiscibility with water or solubility in water at no more than 5%, and a dissolving ability for hydrogen sulfide at temperatures of from −40° to 250° F.

3. The process of claim 2 wherein said second fluid is carbon tetrachloride.

4. The process of claim 3 wherein the ratio of carbon tetrachloride to carbon disulfide is such as to closely match the density of the solid carbonaceous material.

5. The process of claim 2 wherein said second fluid is trichloroethylene, bromoethane, chlorobenzene, methane dichloride, or chloroform.

6. The process of claim 2 wherein said second fluid is any mixture of carbon tetrachloride, trichloroethylene, bromoethane, chlorobenzene, methane dichloride, or chloroform.

7. In a process for gasifying a solid carbonaceous material at elevated temperature and pressure, the improvement which comprises forming a slurry with the carbonaceous material and carbon disulfide at atmospheric pressure, raising the slurry to a pressure of at least the gasification pressure, and evaporating the carbon disulfide from said carbonaceous material prior to gasification of said carbonaceous material.

8. The process of claim 7 wherein the said carbon disulfide is admixed with carbon tetrachloride.

9. The process of claim 8 wherein the carbonaceous material recovered upon evaporation of the slurrying fluid is purged with gaseous carbon disulfide to eliminate traces of carbon tetrachloride in the void volume of the carbonaceous material prior to the gasification of the carbonaceous material.

10. The process of claim 8 wherein the ratio of carbon disulfide to carbon tetrachloride is such as to closely match the density of the solid carbonaceous material.

11. A process for the superatmospheric gasification of a solid carbonaceous material which comprises:

(a) forming a slurry of said carbonaceous material at atmospheric pressure with a recycle fluid consisting of carbon disulfide, carbon tetrachloride, trichloroethylene, bromoethane, chlorobenzene, methane dichloride or chloroform, or mixture of these compounds;

(b) pumping said slurry to a pressure of at least the gasification pressure;

(c) gasifying the carbonaceous material and simultaneously evaporating said recycle slurrying fluid within a gasifier;

(d) scrubbing the resultant product gas with a chilled solution of scrubbing fluid which is essentially the same as said recycle fluid, thereby condensing said evaporated recycle fluid while simultaneously condensing water vapor from said product gas, absorbing sulfur compounds and other soluble compounds from said product gas, and physically removing particulates from said product gas;

(e) treating said scrubbing fluid to remove accumulated particulates and sulfur compounds;

(f) separating said scrubbing fluid from said condensed water;

(g) forming a recycle fluid from a portion of the scrubbing fluid; and (h) recycling the recycle fluid to step (a), whereby substantially no reaction of recycle fluid occurs when gasifying the carbonaceous material.

12. The process of claim 11 wherein at least some of the condensed water from step (f) is atomized into said gasifier of step (c).

* * * * *